United States Patent [19]

Skinner et al.

[11] Patent Number: 5,073,215

[45] Date of Patent: Dec. 17, 1991

[54] ALUMINUM IRON SILICON BASED, ELEVATED TEMPERATURE, ALUMINUM ALLOYS

[75] Inventors: David J. Skinner; Michael S. Zedalis, both of Morris, N.J.

[73] Assignee: Allied-Signal Inc., Morris Township, Morris County, N.J.

[21] Appl. No.: 549,025

[22] Filed: Jul. 6, 1990

[51] Int. Cl.[5] ..... C22C 21/14

[52] U.S. Cl. ..... 148/415; 420/548; 420/551

[58] Field of Search ..... 420/548, 551; 148/415, 148/437

[56] References Cited

U.S. PATENT DOCUMENTS

| | | | |
|---|---|---|---|
| 2,963,780 | 12/1960 | Lyle et al. | 75/249 |
| 2,967,351 | 1/1961 | Roberts et al. | 148/11.5 P |
| 3,462,248 | 8/1969 | Roberts et al. | 148/437 |
| 4,347,076 | 8/1982 | Ray et al. | 75/0.5 R |
| 4,379,719 | 4/1983 | Hildeman et al. | 419/60 |
| 4,647,321 | 3/1987 | Adam | 148/415 |
| 4,828,632 | 5/1989 | Adam et al. | 148/437 |
| 4,878,967 | 11/1989 | Adam et al. | 148/437 |
| 4,879,095 | 11/1989 | Adam et al. | 420/548 |

*Primary Examiner*—Deborah Yee

*Attorney, Agent, or Firm*—Ernest D. Buff; Gerhard H. Fuchs

[57] ABSTRACT

A rapidly solidified aluminum base alloy consists essentially of the formula $Al_{bal}Fe_aSi_bX_c$, wherein X is at least one element selected from the group consisting of W, Ta, Nb, "a" ranges from 3.0 to 7.1 at %, "b" ranges from 1.0 to 3.0 at %, "c" ranges from 0.25 to 1.25 at % and the balance is aluminum plus incidental impurities, with the provisos that the ratio [Fe+X]:Si ranges from abut 2.33:1 to 3.33:1 and that the ratio Fe:X ranges from abut 16:1 to 5:1. The alloy exhibits high strength, ductility and fracture toughness and is especially suited for use in high temperature structural applications such as gas turbine engines, missiles, airframes and landing wheels.

2 Claims, 3 Drawing Sheets

ALUMINUM IRON SILICON BASED, ELEVATED TEMPERATURE, ALUMINUM ALLOYS

BACKGROUND OF THE INVENTION

1. Field of the Invention

The invention relates to aluminum based alloys having strength, ductility, toughness at ambient and elevated temperatures and relates to powder products produced from such alloys. More particularly, the invention relates to Al-Fe-Si-X alloys that have been rapidly solidified from the melt and thermomechanically Processed into structural components having a combination of high strength, ductility, fracture toughness.

2. Brief Description of the Prior Art

Methods of obtaining improved tensile strength in aluminum based alloys have been described in U.S. Pat No. 2,963,780 to Lyle et al.; U.S. Pat. No. 2,967,351 to Roberts, et al.; and U.S. Pat. No. 3,462,248 to Roberts, et al. The alloys taught by Lyle, et al. and by Roberts, et al. were produced by atomizing liquid metals into finely divided droplets by high velocity gas streams. The droplets were cooled by convective cooling at a rate of approximately $10^4$°$Cs^{-1}$. As a result of this rapid cooling, Lyle, et al. and Roberts, et al. were able to produce alloys containing substantially higher quantities of transition elements than has hither to been possible.

Higher cooling rates using conductive cooling, such as splat quenching and melt spinning, have been employed to produce cooling rates of about $10^5$ to $10^6$ $Cs^{-1}$. Such cooling rates minimize the formation of large intermetallic precipitates, with accicular or blocky morphology, during the solidification of the molten aluminum alloy. Such intermetallic precipitates are responsible for premature tensile instability.

U.S. Pat. No. 4,379,719 to Hilderman, et al. discusses rapidly quenched aluminum alloy powder containing 4 to 12 wt % iron and 1 to 7 wt % cerium or other rare earth metals from the lanthanum series.

U.S. Pat. No. 4,647,321 to Adam discusses rapidly quenched aluminum alloy powder containing 5 to 15 wt % iron and 1 to 5 wt % of other transition elements.

U.S. Pat. No. 4,347,076 to Ray, et al. discusses high strength aluminum alloys for use at temperatures of about 350° C. that have been produced by rapid solidification techniques. These alloys, however, have low engineering ductility and fracture toughness at room temperature which precludes their employment in structural applications where a minimum tensile elongation of about 3% is required.

U.S. Pat. Nos. 4,828,632, 4,878,967 and 4,879,095 to Adam et al. discuss rapidly solidified aluminum base alloy powder products of Al-Fe-Si-X where X is specifically vanadium or at least one element from the group V,Mn,Cr,Mo,W,Ta or Nb. However, Al-Fe-Si alloys containing W,Ta or Nb have not been discussed with extent to examples within these patents. Thus a full detailed and specified range of compositions and processes for consolidated articles from such powders has limited their usefulness.

This invention demonstrates the extent of the W,Ta and/or Nb addition to Al-Fe-Si base alloys and thus provides a set of engineeringly useful mechanical properties at ambient and elevated temperatures for these alloy systems.

SUMMARY OF THE INVENTION

The invention provides an aluminum based alloy consisting essentially of the formula $Al_{bal}Fe_aSi_bX_c$, wherein X is at least one element selected from the group consisting of W,Ta,Nb, "a" ranges from 3.0 to 7.1 at %, "b" ranges from 1.0 to 3.0 at %, "c" ranges from 0.25 to 1.25 at % and the balance is aluminum plus incidental impurities, with the provisos that the ratio [Fe+X]:Si ranges from about 2.33:1 to 3.33:1 and that the ratio Fe:X ranges from about 16:1 to 5:1.

To provide the desired levels of ductility, toughness and strength needed for commercially useful applications, the alloys of the invention are subject to rapid solidification processing, which modifies the alloy's microstructure. The rapid solidification processing method is one wherein the alloys are placed into the molten state and then cooled at a quench rate of at least about $10^5$ to $10^7$°$Cs^{-1}$ to form a solid substance. Preferably this method should cool the molten metal at a rate greater than about $10^6$°$Cs^{-1}$ i.e. via melt spinning, splat cooling or planar flow casting which forms a solid ribbon or sheet. These alloys have an as cast microstructure which varies from a microeutectic to a microcellular structure, depending on the specific alloy chemistry. In alloys of the invention the relative proportion of these structures is not critical.

Consolidated articles of the invention are produced by compacting particles composed essentially of an aluminum based alloy consisting essentially of the formula $AlbalFe_aSi_bX_c$, wherein X is at least one element selected from the group consisting of W,Ta,Nb, "a" ranges from 3.0 to 7.1 at %, "b" ranges from 1.0 to 3.0 at %, "c" ranges from 0.25 to 1.25 at % and the balance is aluminum plus incidental impurities, with the provisos that the ratio [Fe+X]:Si ranges from about 2.33:1 to 3.33:1 and that the ratio Fe:X ranges from about 16:1 to 5:1. The particles are heated in a vacuum during the compacting step to a pressing temperature varying from about 300° C. to 500° C., which minimizes coarsening of the dispersed intermetallic phases. Alternatively, the particles are put in a can which is then evacuated, heated to between 300° C. and 500° C. and then sealed. The sealed can is heated to between 300° C. and 500° C. in ambient atmosphere and compacted. The compacted article is further consolidated by conventional practiced methods such as extrusion, rolling or forging.

The consolidated article of the invention is composed of an aluminum solid solution phase containing a substantially uniform distribution of dispersed intermetallic phase precipitates of approximate composition $Al_{13}(Fe,X)_3Si$. These precipitates are fine intermetallics measuring less than 100 nm. in all linear dimensions thereof. Alloys of the invention, containing these fine dispersed intermetallics are able to tolerate the heat and pressure associated with conventional consolidation and forming techniques such as forging, rolling and extrusion without substantial growth or coarsening of these intermetallics that would otherwise reduce the strength and ductility of the consolidated article to unacceptably low levels. Because of the thermal stability of the dispersoids in the alloys of the invention, the alloys can be used to produce near net shape articles, such as wheels, by forging, semi-finished articles, such as T-sections, by extrusion, and plate or sheet products by rolling that have a combination of strength and good ductility both at ambient temperature and at elevated temperatures of about 350° C.

Thus, the articles of the invention are especially suitable for high temperature structural applications such as gas turbine engines, missiles, airframes, landing wheels, etc.

BRIEF DESCRIPTION OF THE DRAWINGS

The invention will be more fully understood and further advantages will be come apparent when reference is made to the following detailed description of the preferred embodiment of the invention and the accompanying drawings in which.

DESCRIPTION OF THE PREFERRED EMBODIMENTS

To provide the desired levels of strength, ductility, elastic modulus and toughness needed for commercially useful applications, rapid solidification from the melt is particularly useful for producing these aluminum based alloys. The alloys of the invention consist essentially of the formula $Al_{bal}Fe_aSi_bX_c$, wherein X is at least one element selected from the group consisting of W,Ta,Nb, "a" ranges from 3.0 to 7.1 at %, "b" ranges from 1.0 to 3.0 at %, "c" ranges from 0.25 to 1.25 at % and the balance is aluminum plus incidental impurities, with the provisos that the ratio [Fe+X]:Si ranges from about 2.33:1 to 3.33:1 and that the ratio Fe:X ranges from about 16:1 to 5:1. The rapid solidification processing typically employs a casting method wherein the alloy is placed into a molten state and then cooled at a quench rate of at least about $10^5$ to $10^7$°$Cs^{-1}$ on a rapidly moving casting substrate to form a solid ribbon or sheet. This process should provide provisos for protecting the melt puddle from burning, excessive oxidation and physical disturbances by the air boundary layer carried along with the moving casting surface. For example, this protection can be provided by shrouding apparatus which contains a protective gas, such as a mixture of air or $CO_2$ and $SF_6$, a reducing gas, such as CO or an inert gas; around the nozzle. In addition, the shrouding apparatus excludes extraneous wind currents which might disturb the melt puddle.

Figure 1:
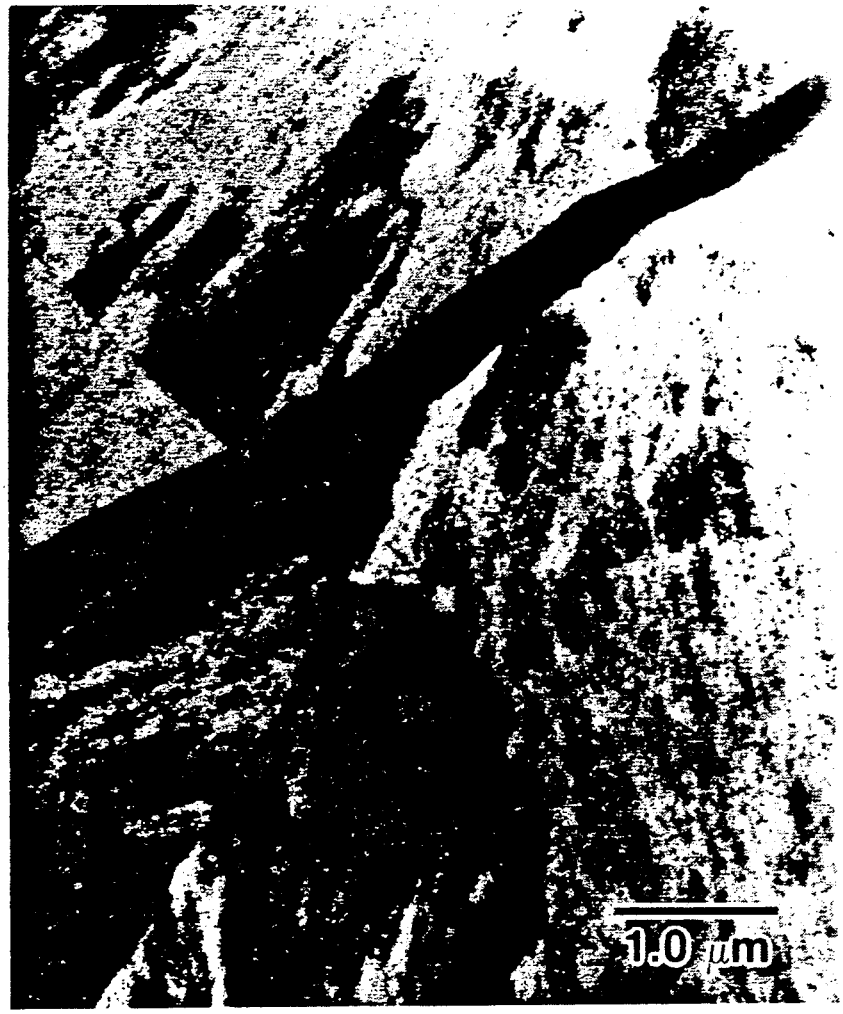
FIG. 1 shows a transmission electron micrograph of an as cast alloy of the invention (alloy $Al_{92.94}Fe_{4.77}W_{0.48}Si_{1.81}$)

As representatively shown in FIG. 1, the as cast alloy of the present invention may have a microeutectic microstructure or a microcellular microstructure.

Rapidly solidified alloys having the $Al_{bal}Fe_aSi_bX_c$ compositions (with the [Fe+X]:Si ratio and the Fe:X ratio provisos) described above have been processed into ribbons and then formed into particles by conventional comminution devices such as pulverizers, knife mills, rotating hammer mills and the like. Preferably, the comminuted powder particles have a size ranging from about −40 to +200 mesh, U.S. standard sieve size.

The particles are placed in a vacuum of less than $10^{-4}$ torr ($1.33\times10^{-2}$Pa.) preferably less than $10^{-5}$ torr ($1.33\times10^{-2}$Pa.), and then compacted by conventional powder metallurgy techniques. In addition the particles are heated at a temperature ranging from about 300° C. to 550° C., preferably ranging from about 325° C. to 450° C., minimizing the growth or coarsening of the intermetallic phases therein. The heating of the powder particles preferably occurs during the compacting step. Suitable powder metallurgy techniques include direct powder extrusion by putting the powder in a can which has been evacuated and sealed under vacuum, vacuum hot compaction, blind die compaction in an extrusion or forging press, direct and indirect extrusion, conventional and impact forging, impact extrusion and combinations of the above.

Figure 2:
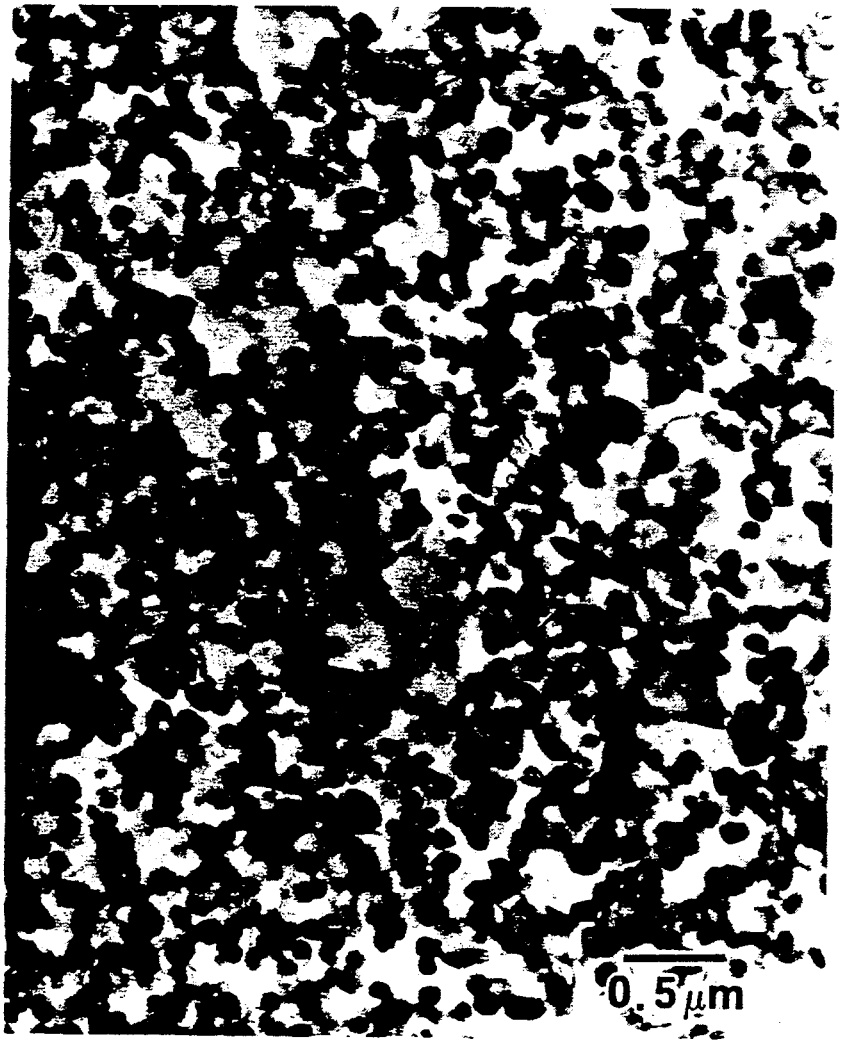
FIG. 2 shows a transmission electron micrograph of a consolidated article of the invention (alloy $Al_{92.94}Fe_{4.77}W_{0.48}Si_{1.81}$)

As representatively shown in FIG. 2, the compacted consolidated article of the invention is composed of a substantially homogeneous dispersion of very small intermetallic phase precipitates within the aluminum solid solution matrix. With appropriate thermomechanical processing these intermetallic precipitates can be provided with optimized combinations of size, e.g. diameter, and interparticle spacing. These characteristics afford the desired combination of high strength and ductility. The precipitates are fine, usually spherical in shape, measuring less than about 100 nm. in all linear dimensions thereof. The volume fraction of these fine intermetallic precipitates ranges from about 10 to 50%, and preferably, ranges from about 20 to 37% to provide improved properties. Volume fractions of coarse intermetallic precipitates (i.e. precipitates measuring more than about 100 nm. in the largest dimension thereof) is not more than about 1%.

Figure 3:
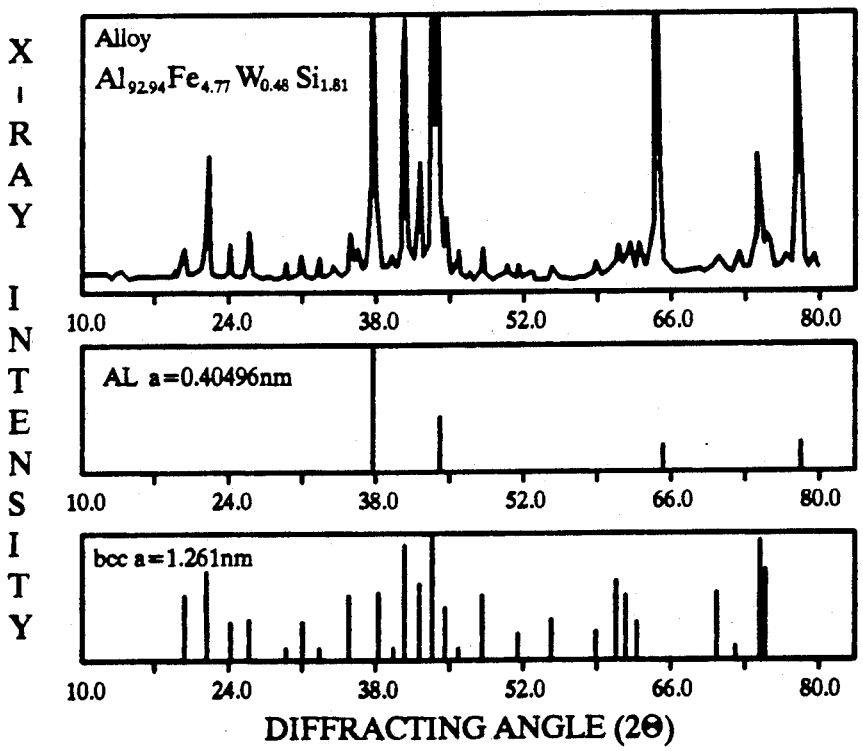
FIG. 3 shows a partial X-ray diffractometer tracing recording the presence of the preferred dispersed intermetallic phase described in the invention contained within the aluminum matrix. (alloy $Al_{92.94}Fe_{4.77}W_{0.48}Si_{1.81}$)

Composition of the fine intermetallic precipitates found in the consolidated article of the invention is approximately $Al_{13}(Fe,X)_3Si$. For alloys of the invention this intermetallic composition range represents about 100% of the fine dispersed intermetallic precipitates found in the consolidated article. The addition of W,Ta and/or Nb elements, listed as X when describing the alloy composition as the formula $Al_{bal}Fe_aSi_bX_c$ (with the [Fe+X]:Si ratio and the Fe:X ratio provisos) stabilizes the quaternary silicide intermetallic precipitate resulting in a general composition of about $Al_{13}(Fe,X)_3Si$. The [Fe+X]:Si and Fe:X ratio provisos defines the compositional boundaries within which 100% of the fine dispersed intermetallic phases are of this general composition. As representatively shown in FIG. 3. X-ray diffraction traces made from consolidated articles according to this invention reveal the structure and lattice parameter of the intermetallic precipitate and of the aluminum matrix. The preferred stabilized intermetallic precipitate structure is cubic (body centered cubic) with a lattice Parameter that is about 1.25 nm. to 1.28 nm.

Alloys of the invention, containing these fine dispersed intermetallic precipitates, are able to tolerate the heat and pressure of conventional powder metallurgy techniques without excessive growth or coarsening of the intermetallics that would otherwise reduce the strength and ductility of the consolidated article to unacceptably low levels. In addition, alloys of the invention are able to withstand unconventionally high processing temperatures and withstand long exposure times at high temperatures during processing. Such temperatures and times are encountered during the production of near net-shape articles by forging and sheet or plate by rolling, for example. As a result, alloys of the invention are particularly useful for forming high strength consolidated aluminum alloy articles. The alloys are particularly advantageous because they can be compacted over a broad range of consolidation temperatures and still provide the desired combinations of strength and ductility in the compacted article.

Further, by ensuring that 100% of the fine dispersed intermetallic phases are of the general composition $Al_{13}(Fe,X)_3Si$ by the application of the [Fe+X]:Si and Fe:X ratio provisos, increases in applicable engineering properties can be enhanced, such as crack growth resistance and fracture toughness.

The following examples are presented to provide a more complete understanding of the invention. The specific techniques, conditions, materials, proportions and reported data set forth to illustrate the principles of the invention are exemplary and should not be construed as limiting the scope to the invention.

EXAMPLES 1 TO 4

Alloys of the invention were cast according to the formula and method of the invention and are listed in Table 1.

Table 1

1. $Al_{92.94}Fe_{4.77}W_{0.48}Si_{1.81}$
2. $Al_{90.89}Fe_{6.12}W_{0.61}Si_{2.38}$
3. $Al_{92.94}Fe_{4.77}Ta_{0.48}Si_{1.81}$
4. $Al_{92.94}Fe_{4.75}Nb_{0.49}Si_{1.82}$

EXAMPLES 5 TO 8

Table 2 below shows the mechanical properties of specific alloys measured in uniaxial tension at a strain rate of approximately $5\times10^{-4}s^{-1}$ at room temperature. Each selected alloy powder was vacuum hot pressed at a temperature of 350° C. for 1 hour to Produce a 95 to 100% density preform slug. These slugs were extruded into rectangular bars with an extrusion ratio of 18:1 at 385° C. to 400° C. after holding at this temperature for 1 hour.

TABLE 2

| Alloy | Temp °C. (°F.) | YS (0.2%) MPa (ksi) | UTS MPa (ksi) | Fracture Strain (%) |
|---|---|---|---|---|
| $Al_{92.94}Fe_{4.77}W_{0.48}Si_{1.81}$ | 24 (75) | 455 (66.0) | 500 (72.4) | 18.6 |
| $Al_{90.89}Fe_{6.12}W_{0.61}Si_{2.38}$ | 24 (75) | 604 (87.5) | 627 (90.8) | 11.3 |
| $Al_{92.94}Fe_{4.77}Ta_{0.48}Si_{1.81}$ | 24 (75) | 394 (57.1) | 462 (66.9) | 17.8 |
| $Al_{92.94}Fe_{4.75}Nb_{0.49}Si_{1.82}$ | 24 (75) | 414 (60.0) | 487 (70.6) | 16.7 |

EXAMPLES 9 TO 11

The alloys of the invention are capable of producing consolidated articles which have excellent thermal stability. Table 3 below shows the mechanical properties of specific alloys measured in uniaxial tension at a strain rate of approximately $5\times10^{-4}s^{-1}$ at room temperature after thermal exposure at 375° C. for either 100 hrs. or 1000 hrs. Each selected alloy powder was vacuum hot pressed at a temperature of 350° C. for 1 hour to produce a 95 to 100% density preform slug. These slugs were extruded into rectangular bars with an extrusion ratio of 18:1 at 385° C. to 400° C. after holding at this temperature for 1 hour.

TABLE 3

| Alloy | Exposure at 375° C. | YS (0.2%) MPa (ksi) | UTS MPa (ksi) | Fracture Strain (%) |
|---|---|---|---|---|
| $Al_{92.94}Fe_{4.77}W_{0.48}Si_{1.81}$ | 100 hrs | 458 (66.4) | 505 (73.2) | 16.7 |
| | 1000 hrs | 450 (65.2) | 496 (71.9) | 16.9 |
| $Al_{90.89}Fe_{6.12}W_{0.61}Si_{2.38}$ | 100 hrs | 601 (87.1) | 629 (91.2) | 11.4 |
| | 1000 hrs | 599 (86.8) | 624 (90.4) | 7.9 |
| $Al_{92.94}Fe_{4.77}Ta_{0.48}Si_{1.81}$ | 100 hrs | 382 (55.3) | 455 (66.0) | 16.8 |
| | 1000 hrs | 350 (50.7) | 421 (61.0) | 10.1 |

Having thus described the invention in rather full detail, it will be understood that these details need not be strictly adhered to but that various changes and modifications may suggest themselves to one skilled in the art, all falling within the scope of the invention as defined by the adjoining claims.

We claim:

1. A rapidly solidified aluminum base alloy consisting essentially of the formula $Al_{bal}Fe_aSi_bX_c$, wherein X is at least one element selected from the group consisting of W, Ta, Nb, "a" ranges from 3.0 to 7.1 at %, "b" ranges from 1.0 to 3.0 at %, "c" ranges from 0.25 to 1.25 at % and the balance is aluminum plus incidental impurities, with the provisos that the ratio [Fe+X]:Si ranges from about 2.33:1 to 3.33:1 and that the ration Fe:X ranges from about 16:1 to 5:1, said alloy having an aluminum solid solution phase containing therein a substantially uniform distribution of dispersed quaternary silicide intermetallic phase precipitates, each of said precipitates being of approximate composition $Al_{13}[Fe,X]_3Si$, measuring less than about 100 nm in any dimension thereof and having a cubic structure.

2. An alloy, as recited in claim 1, having been solidified at a quench rate of at least about $10^5$ to $10^7$° C./sec in a protective gas selected from the group consisting of a mixture of air or $CO_2$ and $SF_6$, a reducing gas, and an inert gas.

* * * * *